United States Patent [19]

Peters et al.

[11] 4,032,424

[45] June 28, 1977

[54] ELECTRICAL CURRENT BREAKER FOR FLUID STREAM

[75] Inventors: Edward J. Peters, Chardon; Wayne P. Zeman, Richmond Heights, both of Ohio

[73] Assignee: Diamond Shamrock Corporation, Cleveland, Ohio

[22] Filed: Dec. 22, 1975

[21] Appl. No.: 643,182

[52] U.S. Cl. ..... 204/258; 204/255; 204/256; 204/263; 204/269; 204/275; 204/279; 55/441

[51] Int. Cl.[2] ..... C25B 1/16; C25B 1/26; C25B 9/00

[58] Field of Search ..... 204/245, 257, 255, 256, 204/258, 263, 265, 266, 269, 275, 279, 278, 225; 210/539; 200/193; 55/441, 257, 248, 221

[56] References Cited

UNITED STATES PATENTS

| | | | |
|---|---|---|---|
| 679,050 | 7/1901 | Girouard | 204/275 X |
| 1,191,356 | 7/1916 | Smith | 204/275 X |
| 2,299,545 | 10/1942 | Jardine | 204/275 X |
| 2,414,741 | 1/1947 | Hubbard | 204/275 |
| 2,669,122 | 2/1954 | Silsby, Jr. | 204/275 X |
| 2,673,232 | 3/1954 | Silsby, Jr. | 204/275 X |
| 3,418,232 | 12/1968 | Emery | 204/275 X |

*Primary Examiner*—Arthur C. Prescott
*Attorney, Agent, or Firm*—William A. Skinner

[57] ABSTRACT

An apparatus for interrupting the passage of electrical current along a mixed stream of gas and liquid.

4 Claims, 4 Drawing Figures

ELECTRICAL CURRENT BREAKER FOR FLUID STREAM

FIELD OF THE INVENTION

This invention relates generally to an apparatus for breaking an electric current carried by a fluid conductor. More particularly, the present invention relates to a device for interrupting the flow of current along a mixed stream of gas and liquid, and is especially useful for electrically isolating individual electrolytic cells of the bipolar type.

BACKGROUND OF THE INVENTION

In numerous chemical reactions conducted using electricity, the products are recovered in the form of a fluent stream of mixed gas and liquid. In such electrochemical reactions where a recirculation loop is present in the system or where the product from a number of reactors is collected in a common receiver, there is a danger of current leakage between different parts of the reaction system or between individual reactors. Such current leakage between elements operating at different voltages or potentials can result in corrosion and loss of efficiency.

The problem is particularly noticeable in chlor-alkali electrolytic cells of the type using bipolar electrodes. In these cells, useful for the electrolysis of brines to produce halogen gas and alkali metal hydroxide, a number of individual electrolytic cell units are assembled in a bipolar mechanical and electrical configuration. Cell units made up of an anode and cathode separated by a partition are connected in series fashion to form an electrolyzer.

In the operation of such cells brine is fed to the anode compartment, where halogen gas is generated, while water is fed to the cathode compartment, where alkali metal hydroxide and co-product hydrogen gas are formed. In some instances the depleted brine and halogen gas are removed from the anolyte compartment through a common outlet, and the alkali metal hydroxide and hydrogen gas likewise flow out of a single outlet from the catholyte compartment. Often the brine and caustic will be further treated and recirculated to the respective compartments of the cell in a type of closed-loop operation.

Since bipolar electrolyzers of this type frequently operate at high current densities, it is important that the individual cells be electrically isolated. The possibility of current dissipation occurring through the product collection streams or the recirculating brine and caustic streams must be minimized for most efficient cell operation. Such current leakage between individual bipolar units or between the cell units and ground can result in a sizeable energy loss in a large electrolyzer, as well as causing severe electrochemical corrosion of the cell and associated piping. It is thus highly desirable to provide a device for interrupting the flow of current along a mixed stream of gas and liquid, and for electrically isolating the individual elements of electrochemical reactors.

SUMMARY OF THE INVENTION

In accordance with the invention there is provided an apparatus for interrupting the passage of electrical current along a mixed gas-liquid stream, which includes an outer enclosure within which is supported an inner receiver of smaller cross-section for receiving the flow of gas and liquid. This inner receiver has an open top and a closed bottom with at least one orifice therein. The flow of gas and liquid is introduced into the inner receiver where the mixture is allowed to separate into discrete phases. The gas moves out the open top of the inner receiver and into the outer enclosure, while the liquid flows by gravity through the orifice and falls vertically, breaking into individual drops and interrupting the passage of electrical current. The gas and liquid then move into either separate or combined collecting means attached to the outer enclosure for removal and further processing.

The device of the invention provides numerous advantages, including an efficient means for disengaging the gas and liquid in a two-phase stream flowing from an electrolytic cell, and simultaneously interrupting the flow of electric current along the stream. The device is compact and simple enough to be used on each individual gas-liquid outlet from an electrolyzer thereby electrically isolating the individual elements, preventing current leakage, and eliminating electrochemical corrosion.

The device is further capable of being easily adjusted in size and capacity to handle any desired volume of gas-liquid flow, and the low-cost materials of construction can be varied to withstand almost any environment of operation.

BRIEF DESCRIPTION OF THE DRAWINGS

Other advantages of the invention will become apparent upon reading the following detailed description and upon reference to the drawings, in which.

Figure 1:
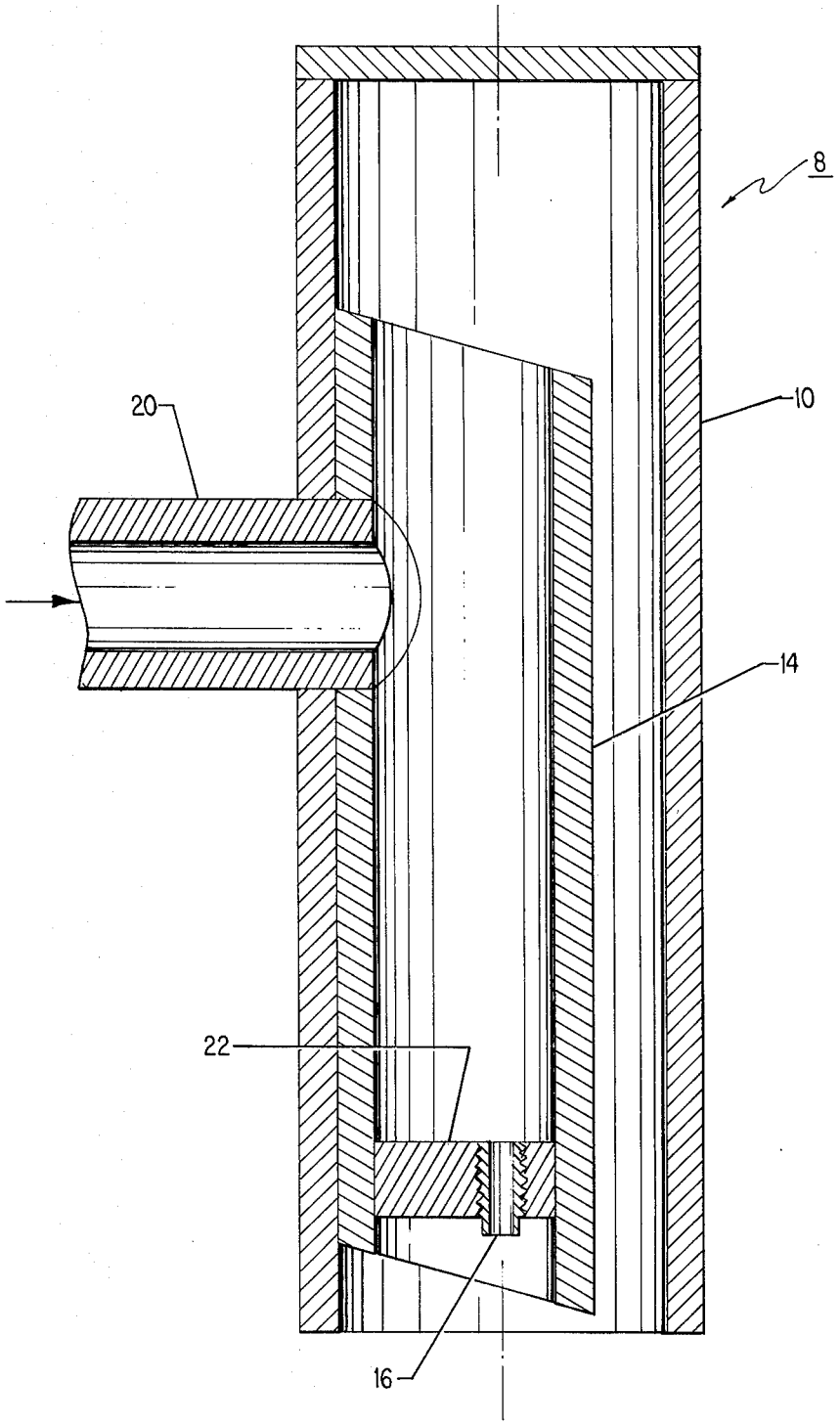
FIG. 1 is a simplified longitudinal section of one embodiment of the current breaker apparatus of this invention.

While the invention will be described in terms of a preferred embodiment, it is to be understood that this is only for purposes of illustration and is not intended to limit the invention. On the contrary, it is intended to cover all alternatives, modifications and equivalents as may be included within the spirit and scope of the invention as defined by the appended claims.

DETAILED DESCRIPTION OF THE INVENTION

Turning to the drawings, there are shown various embodiments of the gas-liquid separator and current breaker apparatus 8 which comprises four principal elements. Gas-liquid inlet 20 carries electrolysis products to the apparatus and into inner receiver 14, which is positioned within an outer enclosure 10. In the bottom plate 22 of the inner receiver 14 is at least one orifice 16. During operation the two-phase stream of liquid and gas from the electrolytic cell enters inlet 20 at a relatively high velocity, impinging on the wall of inner receiver 14 with a foam-breaking action. The liquid and entrained gas are separated with the gas moving out the open top of the inner receiver 14 and into the outer enclosure 10, and the liquid flowing through orifice 16. The liquid falls vertically from the orifice 16, separating into discrete drops and breaking the path of electrical current.

The liquid then falls into collector means 12 which is normally a header common to all of the cells in the electrolyzer. Separate collector means can be used for removing the disengaged gas and liquid from the outer enclosure 10, or more commonly a single header may be used to collect and remove both gas and liquid.

The shape and dimensions of the breaker apparatus 8 may of course be varied to handle a wide range of gas and fluid conditions. For convenience in joining the breaker to related apparatus and piping, the preferred shape is circular, although the inlet 20, receiver 14 and enclosure 10 could be oval, rectangular or any other convenient shape. The dimensions may also be varied to suit any given operating conditions. The receiver 14 can be adjusted in height and volume to accommodate the fluid flow rate, with the only requirement being that the orifice 16 is of a size which allows sufficient flow out of the receiver 14 to avoid spillover. The height of the orifice 16 above the collector means 12 should also be adjusted to insure that the liquid stream separates into discrete drops before reaching the collector. The liquid stream issuing from the orifice will disintegrate within a determinable distance proportional to the size of the orifice and the speed with which the liquid moves. This rate of flow is of course dependent upon the physical characteristics of the liquid, such as temperature and viscosity.

The inner receiver 14 may be designed with slanted edges, as shown in FIG. 1, so as to force liquid to flow over the lower edge of the open top of the receiver. This provides a safety factor in the event that orifice 16 should become plugged or a sudden surge of liquid is introduced into the receiver. The liquid flowing over the top edge of receiver 14 would fall from the lowest slanted edge at the bottom of the receiver and would then separate into drops and break the current path, rather than flowing down the inside of enclosure 10 in a continuous stream.

Figure 2:
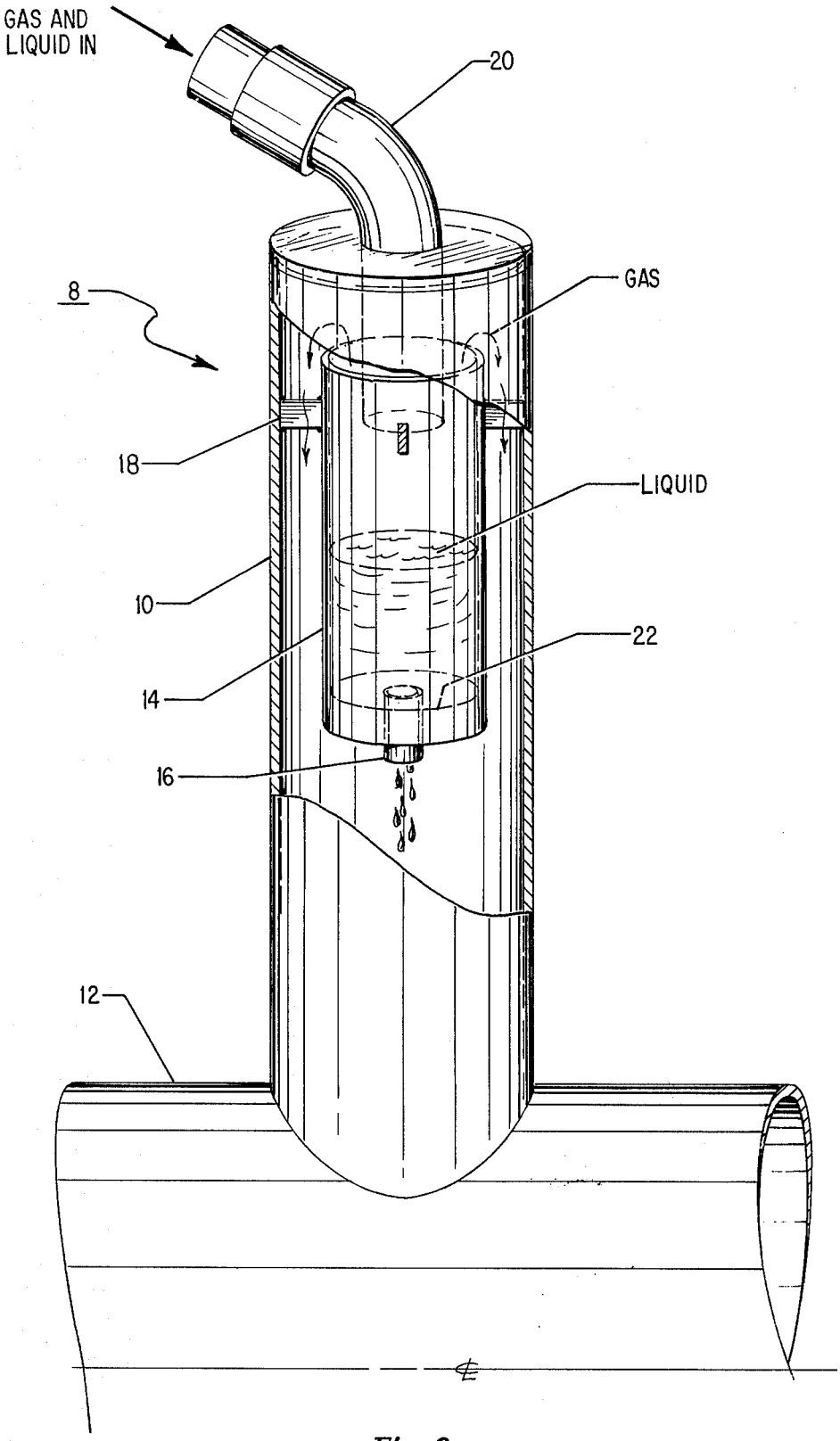
FIG. 2 is a perspective view of another embodiment of the current breaker of this invention.
Figure 3:
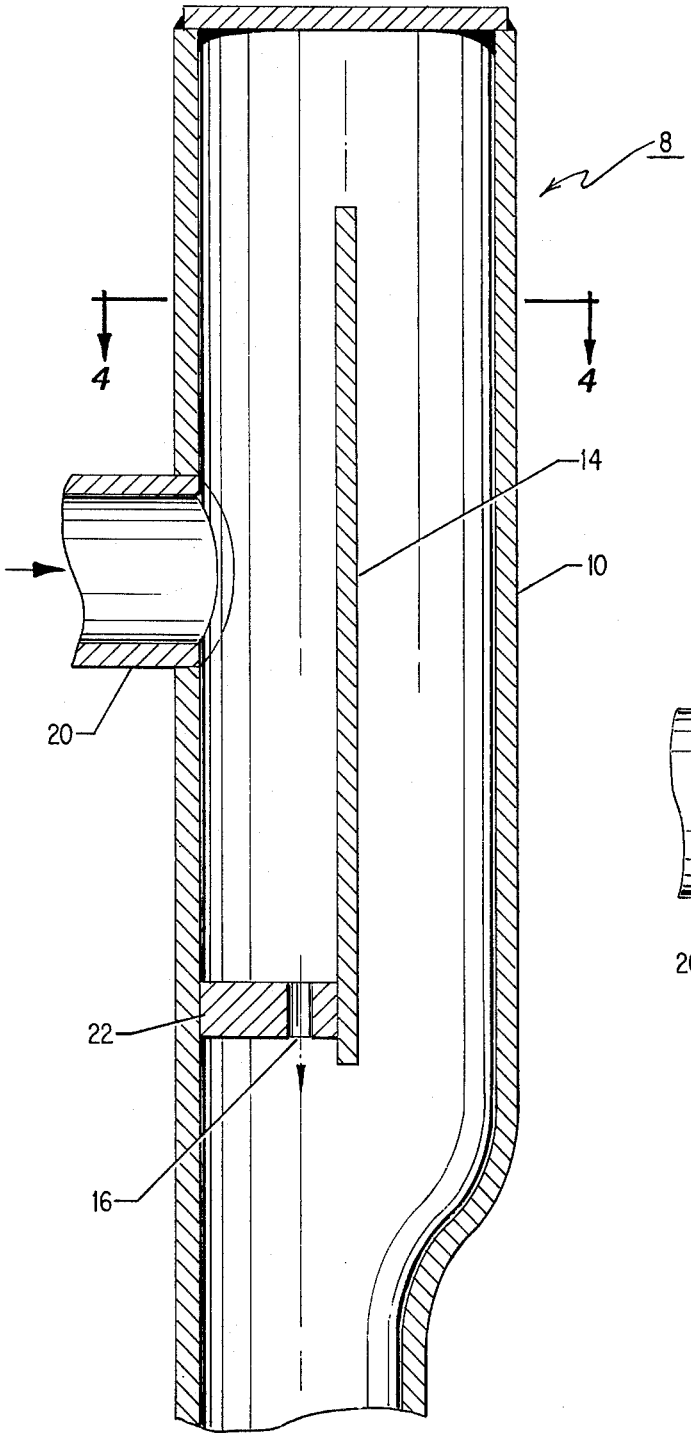
FIG. 3 is a longitudinal section of still another embodiment of the current breaker.
Figure 4:
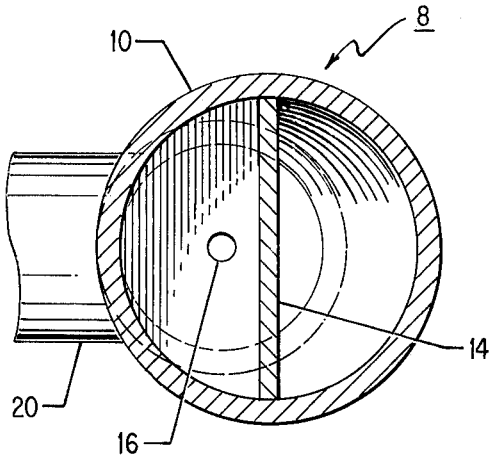
FIG. 4 is a transverse section along line 4—4 of the apparatus shown in FIG. 3.

It is preferred to fasten the inner receiver 14 along the inside wall of outer enclosure 10, as shown in FIG. 1, for ease of construction. Alternatively, receiver 14 may be supported inside enclosure 10 by any convenient means, such as brackets 18, shown in FIG. 2. The receiver may be positioned along the inner wall of enclosure 10, or it may be centered along the longitudinal axis. The inlet 20 may of course be placed either in the open top of receiver 14 or it may enter from the side.

The materials of construction of the apparatus 8 may vary according to the conditions under which the current breaker will be operated. Polymeric materials such as chlorinated polyvinyl chloride (CPVC) have been found to withstand the corrosive environment of a chlor-alkali electrolytic cell quite well, and are readily fabricated and molded. The entire apparatus 8 as well as the principal elements may also be constructed of other corrosion-resistant materials including various polymers, glass, or metals such as nickel, steel, or titanium.

The orifice 16, which may either be simply an opening in the bottom plate 22 of inner receiver 14 or a separate piece fitted into the bottom, should of course also be of a material resistant to attack by liquid flowing through. In chlor-alkali electrolytic cells, materials such as titanium and nickel have been found to withstand the flow of brine anolyte and the caustic catholyte, respectively. Other corrosion and wear resistant materials such as steel are also satisfactory. Orifice 16 may vary in diameter, depending upon the physical properties of the liquid being handled, the flow rate into receiver 14, and the distance between the orifice and collector means 16. The orifice should be large enough to prevent flooding of receiver 14, yet should pass a liquid stream of small enough diameter that it can break into individual drops during the vertical fall to collector 12. In general, the orifice must be at least of sufficient diameter to allow an outflow of liquid from inner receiver 14 at a rate equivalent to that at which the fluid stream is being introduced into the receiver. The orifice is preferably positioned on the centerline of outer enclosure 10 to provide the maximum clearance for the falling drops.

The size of breaker apparatus 8 is easily adapted to fit the particular electrochemical reaction and flow rates involved, and the associated apparatus. The overall dimensions are not critical, so long as inner receiver 14 and outer enclosure 10 are large enough to handle the flow of liquid and gas without flooding. The buildup of pressure in the apparatus 8 and consequent backpressure in the inlet 20 and the cell compartments should also be avoided. The vertical distance through which the liquid falls after leaving orifice 16 must be sufficient to allow the liquid stream to separate into discrete drops. The necessary distance is dependent upon such factors as the volume of receiver 14, properties of the liquid such as viscosity, temperature, etc., as well as the size of orifice 16, and thus may be varied to suit the particular application. In ordinary commercial practice a suitable distance has been found to be on the order of 12 to 80 inches. So long as there is a sufficient distance between the orifice 16 and collector means 12 to allow the liquid stream passing through the orifice to separate into individual drops prior to contacting the liquid in the collector, the passage of electrical current along the stream will be satisfactorily interrupted.

SPECIFIC EMBODIMENT

The current breaker apparatus of the invention has been used in conjunction with a bipolar electrolytic cell producing chlorine and sodium hydroxide. This cell basically consists of anode and cathode compartments separated by an electrolytically conductive membrane. A sodium chloride brine is fed into the anode compartment, where chlorine gas is produced, and water or dilute sodium hydroxide is fed to the cathode compartment, where concentrated sodium hydroxide and hydrogen gas are produced. These mixed gas and liquid product streams were removed from the anode and cathode compartments of each individual cell and were passed through separate current breakers of the invention located in each compartment outlet. The product streams were then collected in common headers for anolyte and catholyte products. The flow of brine out of the anode compartments was in the range of 500 to 1500 ml./minute and the flow of chlorine was in the range of 0.5 to 1.5 SCFM. The flow of sodium hydroxide out of the cathode compartment ranged from 200 to 2000 ml./minute and the flow of hydrogen was in the range of 0.9 to 1.6 SCFM.

A current breaker was installed in each of the brine/chlorine and sodium hydroxide/hydrogen outlets from each cell, with construction as shown in FIG. 1. The material of construction was primarily chlorinated polyvinyl chloride polymer. The outer enclosure 10 was tubular in shape, with an inner diameter of 1.5 inches and an overall length of 7.5 inches. The inner receiver 14 was fabricated from CPVC tube ⅞ inch inside diameter and 5 inches in length, and the gas liquid inlet 20 was located in the side of receiver 14, 1.5 inches from the top. Inlet 20 was press-fitted through a hole in the side of outer enclosure 10 and solvent welded in place. This provided support for the inner receiver 14. The top and bottom of inner receiver 14 were cut at an angle as shown in FIG. 1, to provide protection in the event of an overflow. The bottom of receiver 14 was closed with a CPVC plate 22, into which was fitted a metal tube to provide orifice 16. A titanium tube with an inside diameter of 7 mm. was used for the anolyte breaker orifice and a nickel tube with an inside diameter of 7 mm. was used for the catholyte breaker orifice.

Current breakers of this construction were able to withstand the corrosive environment of the chlor-alkali cell without any deterioration. The vertical fall from the orifice 16 to the gas-liquid collector 12, in this instance a header of CPVC common to a number of cells, was 30 inches. This distance allowed the liquid streams to separate into discrete drops, and no current leakage was observed through the product streams or between individual cells.

What is claimed is:

1. Apparatus for interrupting the passage of electrical current along a mixed stream of gas and liquid, which comprises:

a. an outer enclosure;

b. an inner receiver of smaller cross-section supported totally within the outer enclosure for receiving a flow of mixed gas and liquid, having an open top and a closed bottom with an orifice therein;

c. means for introducing a flow of gas and liquid into the inner receiver, whereby the gas and liquid introduced into the inner receiver are allowed to separate, the gas flowing out the open top of the receiver into the outer enclosure and the liquid flowing out through the orifice where it falls vertically and separates into individual drops;

d. means connected to the outer enclosure for collecting and removing the separated gas and liquid.

2. The apparatus of claim 1 wherein the orifice is formed from a tube of corrosion-resistant metal inserted through the bottom of the inner receiver.

3. In a chlor-alkali electrolyzer having multiple bipolar cell units, each unit including an anolyte compartment separated from a catholyte compartment by a membrane, with inlet and outlet means for feeding and withdrawing continuous fluid streams to and from the individual compartments, the combination with said outlet means of a device to maintain electrical separation of the cell units, which comprises an outer enclosure with an inner receiver of smaller cross-section supported totally therein for receiving the fluid stream, said inner receiver having an open top and a closed bottom with an orifice therein, means for introducing the fluid stream into the inner receiver where gases and liquid in the stream are disengaged with the gases flowing out the open top of the receiver and the liquid flowing through the orifice to fall vertically and separate into discrete drops, and including means connected to the outer enclosure for collecting and removing gases and liquid.

4. The device of claim 3 wherein the orifice is formed from a tube of metal selected from titanium, nickel and steel.

* * * * *